United States Patent [19]

Converse et al.

[11] Patent Number: 4,556,430

[45] Date of Patent: Dec. 3, 1985

[54] PROCESS FOR HYDROLYSIS OF BIOMASS

[75] Inventors: Alvin O. Converse, Norwich, Vt.; Hans E. Grethlein, Hanover, N.H.

[73] Assignee: Trustees of Dartmouth College, Hanover, N.H.

[21] Appl. No.: 668,672

[22] Filed: Nov. 5, 1984

Related U.S. Application Data

[63] Continuation of Ser. No. 428,592, Sep. 20, 1982, abandoned.

[51] Int. Cl.[4] ..... C13K 1/02

[52] U.S. Cl. ..... 127/36; 127/37

[58] Field of Search ..... 127/36, 37; 435/99, 435/105, 163, 165

[56] References Cited

U.S. PATENT DOCUMENTS

| | | | |
|---|---|---|---|
| 1,428,217 | 9/1922 | Classen | 127/37 |
| 2,220,846 | 11/1940 | Neu | 127/37 |
| 2,959,500 | 11/1960 | Schlapfer et al. | 127/37 |
| 2,974,067 | 3/1961 | Apel | 127/37 |
| 4,201,596 | 5/1980 | Church et al. | 435/163 X |
| 4,237,226 | 12/1980 | Grethlein | 435/99 |
| 4,409,032 | 10/1983 | Paszher et al. | 127/37 |

*Primary Examiner*—Kenneth M. Schor

*Attorney, Agent, or Firm*—Robert Shaw

[57] ABSTRACT

A process for hydrolysis of biomass wherein the biomass is mixed with a small amount of an aqueous acid to produce a wet meal. A non-aqueous carrier fluid is used to form a slurry of the biomass, and the temperature and pressure are established at appropriate levels to effect hydrolysis of the biomass to decomposition products that include sugar for a time period that is sufficient for the hydrolysis to occur.

23 Claims, No Drawings

PROCESS FOR HYDROLYSIS OF BIOMASS

This is a continuation of U.S. Ser. No. 428,592, filed Sept. 20, 1982, now abandoned.

I. BACKGROUND OF THE INVENTION

A. Field of the Invention

The present invention relates to processes for acid hydrolysis of biomass.

Attention is called to U.S. Pat. No. 4,237,226 (Grethlein), as well as the further art made of record therein, including the Thompson thesis which describes, among other things, a continuous plug-flow reactor that may be employed to practice the present invention. Attention is also called to a writing entitled "Pentosan Hydrolysis in a Concentrated Slurry System" (Horwarth et al)

B. Setting for the Invention

While the present invention has use in conjunction with other sugars than glucose, the production of glucose from the carbohydrates (e.g. cellulose) in biomass is discussed mostly hereinafter. (The term biomass includes plant materials, that is, any material that comes from photosynthesis and products derived therefrom, even in the waste state. Included in biomass are cellulose, including hemicellulose, other carbohydrates and proteins, lignins, and extractable (e.g., resins and tars.)) Among other things, conversion of cellulosic material to glucose, and subsequent fermentation to ethanol, is a method to utilize a portion of solid waste or biomass. Currently, the usual method used for cellulosic conversion involves acid hydrolysis of the cellulosic polymer, in water, at high temperature with dilute mineral acid; the cellulosic content is usually low due to difficulties of mixing and pumping a slurry containing more than 15% by weight dry biomass. About fifty percent of the potential glucose is actually converted in seconds, but by-product formation and high energy requirements presently limit use of this conversion mechanism.

C. Objects of the Invention

It is an objective of the present invention to provide a process for the acid hydrolysis of biomass for producing glucose and/or other sugars from carbohydrate components (e.g., cellulose) and the like therein.

Another objective is to provide a process for producing glucose and/or other sugars in which a non-aqueous support fluid is used as a means for producing a pumpable cellulosic substrate.

Still another objective is to provide a process for producing glucose and/or other sugars in which a non-aqueous support fluid is used as a way to reduce the amount of water involved in the acid hydrolysis of the biomass, thereby obtaining high sugar concentrations in the aqueous phase of the slurry.

A further objective is to provide other decomposition products of biomass (e.g., furfural).

These and still further objectives are addressed hereinafter.

D. Summary of the Invention

The foregoing objects are achieved in a continuous-flow conversion process by which biomass is converted by acid hydrolysis to glucose and/or other sugars, that comprises the steps of producing a slurry comprising biomass and a non-aqueous, liquid hydrocarbon or hydrocarbon derivative and an aqueous acid; rapidly heating the slurry to a temperature sufficient that hydrolysis of the carbohydrate component and the like of the biomass is realized but for a time interval sufficiently short to minimize decomposition of the sugars; quenching the reaction; and washing the post-reaction solids to remove the sugars therefrom.

II. DETAILED DESCRIPTION OF THE INVENTION

According to the present teaching, particulate biomass is mixed with a small amount of aqueous acid or other suitable acid solution to form a wet meal. A slurry is produced by introducing to the wet meal a non-aqueous liquid hydrocarbon or hydrocarbon derivative support fluid. A continuous plug flow reactor of the type described in the Thompson thesis made of record in the Grethlein patent may be employed to allow for rapid heating by injection of steam in the reaction zone and acidification of the slurry before entry to the reaction zone, controlled reaction time and rapid quenching of the hydrolyzed slurry by flash cooling using an orifice. The continuous flow process permits better control over the reaction conditions (e.g., short reaction time of about 4 to 15 seconds and relatively high temperature) and, in general, it reduces labor costs and, perhaps, capital costs. Acid is typically added prior to entry into the reaction zone. The major heating component occurs by injecting steam into the slurry in the reaction zone, but some preheating may be employed.

The non-aqueous liquid hydrocarbon or hydrocarbon derivative which is immiscible in water is used to provide a pumpable slurry while avoiding surplus water so that sugar in the aqueous product is more concentrated. The reaction conditions are achieved by maintaining the temperature of the slurry in the range between about 160° C. to 260° C., and maintaining the acid concentration and reaction time such that the carbohydrate component of the biomass is hydrolized to sugars but that minimizes the decomposition of the sugars.

The key feature here is that by the use of a non-aqueous liquid hydrocarbon or hydrocarbon derivative as a support fluid, high sugar concentrations are obtained in the aqueous portion of the slurry. The immiscible fluids reduce the amount of water present and needed in the slurry, with the sugars dissolved in the aqueous phase, the biomass hydrocarbons in the non-aqueous phase and the lignin in the biomass dissolved in the non-aqueous phases or distributed between the aqueous phase and the non-aqueous phase.

A specific example is given below for Wilner #247 wood chips which contained about 7–8% $H_2O$ and using kerosene as the support fluid. 1.0 kg. of Wilner #247 wood chips was mixed with 800 g. of 5% $H_2SO_4$ and suspended in 8.0 liters of kerosene. Using a plug flow reactor the inventors subjected the slurry to the temperature and for the reaction time shown in Table I at pressures sufficient enough to maintain the carrier in the liquid phase and obtained the additional data shown in Table I.

As will be noted from the data in Table I the feed is diluted by the steam injected in the reactor. Since more steam is required for higher temperatures, the dilution is increased and the acid concentration falls off.

EXPLANATION OF TABLE I

The first row in Table I refers to the data of the feed stream. The lower three rows refer to the product when processed under reaction conditions indicated in columns A and B which give temperature and residence time in the reactor. The total weight of the sample of the product material is presented in column C. The kerosene was removed and the remaining aqueous layer weighed, and the results are presented in column D. The weight of the solids in this aqueous layer is presented in column E, and the weight of the aqueous liquid phase, that is the difference between column D and column E, is presented in column F. The concentration of the solids in the feed, in terms of grams of solid per milliliter of kerosene, is given in column G. In column $G^1$, the acid concentration in the aqueous phase of the sample is given. It will be noted that the acid concentrations in the product streams are considerably below that of the feed owing to the dilution caused by steam injection. Column H refers to the solids that would have been found in the product sample had there been no reaction; it is based on the ratio of solids to kerosene presented in column G. The term $G_f$ in the formula refers to the quantity in the first row of column G. By knowing the amount of kerosene in the actual product sample and the solids to kerosene ratio in the feed, it is possible to compute the solids that would have been in the product sample had there been no reaction, as presented in column H. The corresponding potential glucose and xylose are presented in columns I and J. These are based on previously determined quantitative saccharifications of the solids. The solids in the product sample are filtered and washed. The entire weight of the filtrate, including the wash water, is presented in column K. The concentration of glucose in this material is presented in column L. The glucose concentration in the original aqueous protion of the product sample is presented in column M. The glucose found in the sample, as compared to the potential glucose originally present in the solids is presented in column N. The figure in column N is in percent and, for example, the value corresponding to the temperature of 220 indicates that 47.3% of the potential glucose was actually recovered in the filtrate and wash water. Column N indicates that for these reaction conditions the glucose concentration in the aqueous phase of the product was 24.2 grams per liter, or approximately 2.4 wt. %. The values in columns O, P and Q give for xylose the same as columns L, M and N give for glucose. Thus, for the temperature of 220, 89% of the potential xylose was recovered in the filtrate and wash water, and the concentration of xylose in the aqueous phase of the product was approximately 2%. Columns R and S give the potential glucose and xylose remaining in the residue solids. It will be noted that the percentage of glucose potential has increased over that of the original feed, due to the fact that some of the solids have been decomposed.

TABLE I

| Temp. (°C.) A | Reaction time (sec.) B | Sample Weight C g. | Aq. layer (kerosene removed) D g. | Residue E g. | Aq. Phase (D − E) F g. | E/(C − D)/$d_k$* G g./ml | Acid conc. in F (%)** $G^1$ | Solids · $\left(\frac{C-D}{d_k} \cdot G_f\right)$ Charged H g. | Pot. Glu. (0.42 · H) I g. | Pot. Xyl. (0.18 · H) J g. |
|---|---|---|---|---|---|---|---|---|---|---|
| Feed | — | 51.17 | ~10.5 | 5.276 | ~5.23 | .105 | 5 | — | — | — |
| 180° | 11.5 | 54.52 | 19.74 | 3.266 | 16.47 | — | 1.69 | 5.25 | 2.21 | 0.95 |
| 200° | 10.2 | 50.60 | 22.98 | ~2.9 | 2.01 | — | 1.29 | 3.57 | 1.50 | 0.64 |
| 220° | 10.6 | 53.96 | 28.77 | ~2.1 | 26.7 | — | 1.003 | 3.25 | 1.37 | 0.59 |

| Weight (includes wash water) K g. | Glu. conc. in K L g./l. | Glu. conc. in F $\left(\frac{KL}{F}\right)$ M g./l. | Glu. % Pot. $\left(\frac{KL}{I}\right)$ N % | Xyl. conc. in K O g./l. | Xyl. conc. in F $\left(\frac{KO}{F}\right)$ P g./l. | Xyl. % Pot. $\left(\frac{KO}{J}\right)$ Q % | % Glu. Residue*** R | % Xyl. Residue*** S |
|---|---|---|---|---|---|---|---|---|
| — | — | — | — | — | — | — | — | |
| 108.0 | 0.745 | 4.89 | 3.65 | 4.6 | 30.2 | 52.5 | 56.7 | 6.03 |
| 74.9 | 3.512 | 12.9 | 17.6 | 10.76 | 39.6 | 125.5 | 57.7 | 2.0 |
| 59.5 | 10.86 | 24.2 | 47.3 | 8.76 | 19.5 | 89.0 | 46.6 | 1.0 |

Filtrate - Aq. Phase

*$d_k$ = 0.813 gl/ml
**Neglects $H_2O$ in Wilner wood flour.
***Overall weight decreased due to reaction; %, therefore, increased as glucose has stayed constant.

A second example is given below again using Wilner #247 wood flour and kerosene. 1.5 kg. of Wilner #247 wood flour which contain about 8% $H_2O$ were mixed with 600 g. of 10% $H_2SO_4$ and kept overnight in an oven at 62° C. The mixture was then suspended in 8.0 liters of kerosene. The slurry was then passed through a plug flow reactor at a sufficient enough pressure to maintain the carrier in the liquid phase and at the temperature and for the reaction time shown in Table II.

EXPLANATION OF TABLE II

As in Table I, the temperature and residence time are given in the first two columns. In columns C and D the sample weight and weight of the aqueous layer in the sample are given. Columns E and F pertain to the kerosene, E giving the weight and F giving the volume. The amount of solid residue in the sample is given in column G. This sample, as before, was filtered and washed. The weight of the filtrate and wash water is given in column H, and the glucose and xylose contents in columns I and J. The weight of the aqueous liquid phase in the original product sample is given in column K, and the concentrations of glucose and xylose in that undiluted aqueous phase are given in columns L and M. Note should be taken that the concentration of glucose and xylose in this product have been increased to a maximum value of 3.96% for the glucose and under the lower temperature conditions, 5.26% for the xylose. One of the objectives of this method of processing is to increase sugar concentrations in the aqueous phase of the product, and these data as well as the data in the other tables demonstrate this effect. The amount of solids in the sample as charged to the reactor are presented in column N, and the potential glucose and xylose in those solids in columns O and P. The percent of the potential glucose that was actually recovered in the aqueous product phase is presented in columns Q and R.

TABLE II

| Temperature | Reaction Time | Sample Weight | Aq. layer (kerosene removed) | Weight (C − D) Kerosene | Volume Kerosene | Residue | Weight Aqueous Phase plus wash water | % Glucose Aqueous Phase plus wash water | % Xylose Aqueous Phase plus wash water |
|---|---|---|---|---|---|---|---|---|---|
| A | B | C | D | E | F | G | H | I | J |
| °C. | sec. | g. | g. | g. | ml. | g. | g. | | |
| 197 | 8.9 | 57.98 | 20.44 | 37.54 | 46.17 | 3.37 | 33.54 | 0.75 | 2.68 |
| 220 | 9.2 | 67.66 | 34.75 | 32.91 | 40.48 | 3.74 | 55.56 | 2.21 | 1.69 |
| 248 | ? | 53.68 | 22.12 | 31.56 | 38.82 | 1.11 | 65.56 | 1.24 | 2.35 |

| Weight (D − G) | % Glu. $\left(I\frac{H}{K}\right)$ | % Xyl. $\left(J\frac{H}{K}\right)$ | Solids (F · 0.1725) | Pot. Glu. (N · 0.42) | Pot. Xyl. (N · 0.18) | % Glu. $\left(\frac{K \cdot L}{O}\right)$ | % Xyl. $\left(\frac{K \cdot M}{P}\right)$ |
|---|---|---|---|---|---|---|---|
| | Aqueous Phase undiluted | | charged into reactor | | | Yield | |
| K | | | N | O | P | | |
| g. | L | M | g. | g. | g. | Q | R |
| 17.07 | 1.47 | 5.26 | 7.96 | 3.34 | 1.43 | 7.50 | 62.7 |
| 31.01 | 3.96 | 3.03 | 6.98 | 2.93 | 1.26 | 41.9 | 74.6 |
| 21.01 | 3.87 | 0.733 | 6.70 | 2.81 | 1.21 | 28.9 | 12.8 |

A third and final example is also given below using Wilner #247 wood flour containing about 8% $H_2O$ and using perchloroethylene ($C_2Cl_4$) as the support fluid. 1.5 kg. of Wilner #247 wood chips were mixed with 800 g. of 5% $H_2SO_4$ and suspended in 8.0 liters of $C_2Cl_4$ to form a slurry. The slurry was passed through a plug flow reactor at a sufficient enough pressure to maintain the carrier in the liquid phase and at the temperature and for the reaction time shown in Table III.

EXPLANTION FOR TABLE III

The data in Table III follow exactly the format in Table II. As indicated in columns L and M. the percent glucose and xylose in the aqueous phase of the product are increased, in this case the maximum glucose value being 4.99% and the maximum xylose value 5.39%. The yields indicate a maximum xylose yield of 98.97 and a maximum glucose yield of 53.39%. In summary, the data indicate the success in the ability to increase the sugar concentration in the product aqueous phase. The yields achieved are essentially unchanged from that in which only aqueous fluids are used.

What is claimed is:

1. A process for hydrolysis of biomass, that comprises: mixing particulate biomass with a small amount of an aqueous acid to produce a wet meal; introducing a non-aqueous liquid carrier to the biomass to produce a slurry, said non-aqueous liquid being immiscible in water; and continuously feeding the slurry through a reaction zone whose pressure and temperature are controlled for a prescribed time to effect hydrolysis of the carbohydrate component of the biomass to decomposition products that include sugar.

2. A process according to claim 1 wherein the temperature of the slurry is elevated prior to continuously feeding the slurry through a reaction zone.

3. A process according to claim 1 wherein the temperature of the particulate biomass is elevated prior to the introduction of the acid.

4. A process according to claim 1 where in the slurry is pumpable.

5. A process according to claim 1 in which the non-aqueous liquid carrier is a hydrocarbon.

TABLE III

| Temp. | Sample weight | Aq. layer ($C_2Cl_4$ removed) | Weight (B − C) $C_2Cl_4$ | Volume $C_2Cl_4$ | Weight (Dry) Pot. Glu. | % Pot. Glucose Pot. Glu. | Weight Pot. Glu. (F · G) Residue Pot. Glu. | % Pot. Xylose Pot. Xyl. | Weight Pot. Xyl. (F · I) Pot. Xyl. | Weight (C − F) Aqueous Phase | % Glucose Aqueous Phase | % Xylose Aqueous Phase |
|---|---|---|---|---|---|---|---|---|---|---|---|---|
| A | B | C | D | E | F | | | | | L | | |
| °C. | g. | g. | g. | ml. | g. | G | H | I | J | K | g. | M |
| 200 | 107.1 | 29.81 | 77.29 | 47.62 | 3.22 | 59.5 | 1.92 | 3.3 | 0.11 | 26.59 | 0.937 | 5.39 |
| 220 | 110.2 | 38.01 | 72.19 | 44.48 | 3.58 | 57.3 | 2.05 | 1.4 | 0.05 | 34.43 | 2.68 | 3.97 |
| 240 | 106.0 | 35.66 | 70.34 | 43.34 | 2.05 | 44.6 | 0.91 | — | — | 33.61 | 4.99 | 3.08 |

| Solids (E · 172.5) | Total (N · 0.42) Glucose | Net (O − H) Glucose | Total (N · 0.18) Xylose | Net (Q − J) Xylose | % Glucose $\left(\frac{K \cdot L}{O}\right)$ | % Xylose $\left(\frac{K \cdot M}{Q}\right)$ | Reaction Time |
|---|---|---|---|---|---|---|---|
| | Charged into reactor | | | | Yield | | |
| N | O | P | Q | R | S | T | U |
| g. | g. | g. | g. | g. | | | sec. |
| 8.21 | 3.45 | 1.53 | 1.48 | 1.37 | 7.22 | 96.75 | 9.1 |
| 7.67 | 3.22 | 1.17 | 1.38 | 1.33 | 28.65 | 98.97 | 8.3 |
| 7.48 | 3.14 | 2.23 | 1.35 | 1.35 | 53.39 | 76.76 | 8.4 |

$C_2Cl_4d$ = 1.623

Further modifications of the invention herein disclosed will occur to persons skilled in the art and all such modifications are deemed to be within the scope of the invention as defined by the appended claims.

6. A process according to claim 1 in which the non-aqueous liquid carrier is a hydrocarbon derivative.

7. A process according to claim 1 wherein the sugar is dissolved in the aqueous phase, hydrocarbons in the biomass are suspended in the non-aqueous phase, and lignin in the biomass is dissolved preferentially in the non-aqueous phase or is distrbuted between the aqueous phase and the non-aqueous phase.

8. A process according to claim 1 in which the non-aqueous liquid carrier is kerosene.

9. A process according to claim 1 wherein the non-aqueous liquid carrier is perchloroethylene.

10. A process according to claim 1 wherein the pressure is sufficient to maintain the carrier in the liquid phase.

11. A process according to claim 1 wherein the temperature, pressure and prescribed time are interrelated to realize significant hydrolysis to sugars and yet minimize decomposition of the sugars.

12. A process according to claim 11 in which the temperature is in the range from about 160° C. to 260° C. and the pressure in the reaction zone is maintained in the range from about 400 psi to 800 psi.

13. A process according to claim 1 wherein the non-aqueous liquid is a hydrocarbon, wherein the slurry is hydrolyzed in a reactor and is pumped through the reaction zone as a continuous flow and wherein sufficient liquid hydrocarbon is introduced to produce a pumpable slurry for continuous flow reaction within the reactor while avoiding surplus water in the decomposition products so that the sugar in the decomposition products is of a high concentration.

14. A process according to claim 1 that includes abruptly terminating all chemical reactions after said prescribed time.

15. A process according to claim 14 in which said terminating is accomplished by abruptly reducing the pressure and thereby effecting flash cooling.

16. A process according to claim 15 wherein the vapor formed upon flashing is separated from the slurry to increase the sugar concentration in the aqueous phase.

17. A process according to claim 14 that further includes separating the solid, the aqueous liquid phase, and the non-aqueous liquid phase from one another.

18. A process according to claim 17 that further includes washing the solid with an aqueous solution to remove the sugars therefrom.

19. A process according to claim 17 that further includes washing the solid with a water to remove the sugars therefrom.

20. A process according to claim 1 wherein the aqueous acid is in the range from about 2 percent to 12 percent.

21. A process according to claim 1 in which the non-aqueous liquid carrier is a liquid fuel, which liquid fuel acts to dissolve lignin and other extractables to increase the amount of the liquid fuel.

22. A process according to claim 1 in which the decomposition products include furfural.

23. A process for hydrolysis of biomass to convert carbohydrate components to sugar, the process comprising: mixing particulate biomass with a sufficient amount of an aqueous acid to produce a wet meal; introducing a sufficient amount of a nonaqueous liquid carrier to the biomass to produce a pumpable slurry and to concentrate sugar in the aqueous phase of said slurry; said non-aqueous liquid being immiscible in water and continuously feeding the slurry through a reaction zone whose pressure and temperature are controlled for a residence time of about 4 to 15 seconds to effect hydrolysis of the carbohydrate component of the biomass to provide decomposition products that include sugar.

* * * * *